US005105714A

United States Patent [19]

Sprafke et al.

[11] Patent Number: 5,105,714

[45] Date of Patent: Apr. 21, 1992

[54] ARMORED COMBAT VEHICLE, ESPECIALLY A MILITARY TANK

[75] Inventors: Uwe Sprafke, Schauenburg-Elmshagen; Michael Fehr, Wabern-Udenborn; Rudolf Brockmeyer, Schauenburg, all of Fed. Rep. of Germany

[73] Assignee: Wegmann & Co. GmbH, Kassel, Fed. Rep. of Germany

[21] Appl. No.: 614,318

[22] Filed: Nov. 15, 1990

[30] Foreign Application Priority Data

Nov. 21, 1989 [DE] Fed. Rep. of Germany ..... 3938584

[51] Int. Cl.[5] ..... F41H 5/22; B60J 9/02

[52] U.S. Cl. ..... 89/36.08; 49/67; 109/68; 114/117

[58] Field of Search ..... 114/201 R, 116, 117; 49/67; 109/64, 67, 68, 74; 89/36.08, 36.13

[56] References Cited

U.S. PATENT DOCUMENTS 652,462 6/1900 Kessler ..... 114/117
902,050 10/1908 Brintnell et al. ..... 109/68
2,204,328 6/1940 Swanson ..... 49/67
2,855,038 10/1958 Greer ..... 114/201 R
3,131,598 5/1964 Bair ..... 89/36.08
3,198,094 8/1965 Dunkerley ..... 49/67
3,302,331 2/1967 Strum et al. ..... 114/117
4,576,085 3/1986 LeBlanc ..... 89/36.13

FOREIGN PATENT DOCUMENTS 0160688 9/1984 Japan ..... 114/201 R

*Primary Examiner*—David H. Brown
*Attorney, Agent, or Firm*—Sprung Horn Kramer & Woods

[57] ABSTRACT

An armored combat vehicle, especially a military tank, with at least one entry-and-exit hatchway in the top. The hatchway closes with a hatch completely covering it. At least two additional moving roof-protection hatches above the hatch that completely covers the hatchway extend in the same plane at least when they are closed, each covering part of the hatchway and both covering it completely.

8 Claims, 4 Drawing Sheets

ARMORED COMBAT VEHICLE, ESPECIALLY A MILITARY TANK

BACKGROUND OF THE INVENTION

The invention concerns an armored combat vehicle, especially a military tank, with at least one entry-and-exit hatchway in the top that closes with a hatch completely covering it.

The hatches in known armored vehicles are unbolted, lifted, and pivoted or folded up and down. Since contemporary combat vehicles must be securely protected against missiles, their hatches are very heavy. The weight is even greater when the vehicle's armor is thick enough to resist threats from the sky. In the latter case the hatch can be heavy enough to considerably complicate the mechanism that opens and closes it.

Dividing a hatch into two components that differ in bulk and function is known. The upper component, which includes most of the mass and is responsible for protecting the vehicle, is neither lifted nor pivoted, but slides parallel with the plane of closure. The second component, which is less massive, moves perpendicular to the closure plane and, when the hatchway is closed, assumes the task of sealing it off.

This hatch occupies a lot of space, and it takes a relatively long time to open and close the hatchway.

SUMMARY OF THE INVENTION

The object of the invention is to generally improve the hatch in a combat vehicle of the aforesaid type to the extent that it will not occupy much space even when thickly armored and that the hatchway can be relatively rapidly opened and closed with the operator exerting no more effort than on a known hatch.

This object is attained in accordance with the invention by at least two additional moving roof-protection hatches above the hatch that completely covers the hatchway, extending in the same plane at least when they are closed, and each covering part of the hatchway and both covering it completely.

The basic principle of the invention is to dissect the hatch into a total of three components, one of which represents the conventional hatch and completely seals off the hatchway, with the two halves that constitute the roof protection and reinforce the armor mounted above it. When the hatchway is round, each roof-protection component will be semicircular, and, when it is of another shape, each will be half that shape. It is, however, not absolutely necessary for each half to be the same size and shape.

Both the roof protection and the hatch can execute the opening and closing motions that are familiar with hatches. Both the hatch and the two roof-protection components for example can be designed to fold up as will be described hereinafter. It is, however, also possible for the two roof-protection components to fold up and the hatch to first be lifted vertically out of its closed state and then pivoted to the side around a vertical axis as is also described hereinafter with reference to examples.

The two roof-protection components can of course also be designed to slide in opposite directions or pivot to the side when opening and closing.

The hatch and the roof-protection components in one especially advantageous embodiment of the invention are mounted on a rotating ring.

Some of the advantages of the hatch in accordance with the invention will no be listed.

a) Existing vehicles can be inexpensively refitted, while being provided with thicker armor for example.
b) Not much more space will be occupied inside the vehicle, whether it is being outfitted for the first time or refitted.
c) The hatchway can be opened and closed relatively rapidly.
d) The operator does not need to exert any more effort than previously.
e) The three-part hatch—the actual hatch and the two roof-protection components, can be mounted on one rotary ring without any particular problems.

A gun carriage can also be mounted on the ring. The mechanisms can be designed to allow the gun carriage to revolve easily even when the vehicle is on sloping ground by making the hatch and gun carriage weigh the same as the roof-protection hatch.

The weights of the hatch components are counterbalanced in a known way with compensation springs while the hatchway is being opened and closed.

Embodiments of the invention will now be described with reference to the drawings, wherein

DETAILED DESCRIPTION OF THE INVENTION

Figure 1:
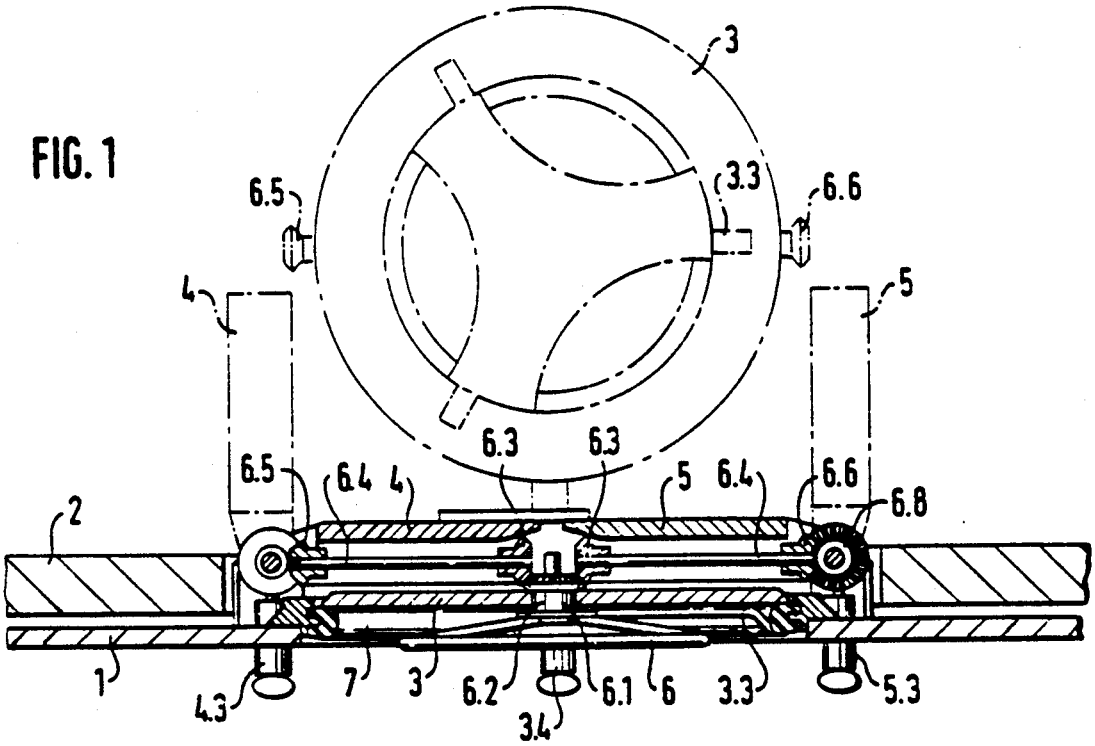
FIG. 1 is a section through the vicinity of a hatchway in the roof of a combat vehicle.
Figure 2:
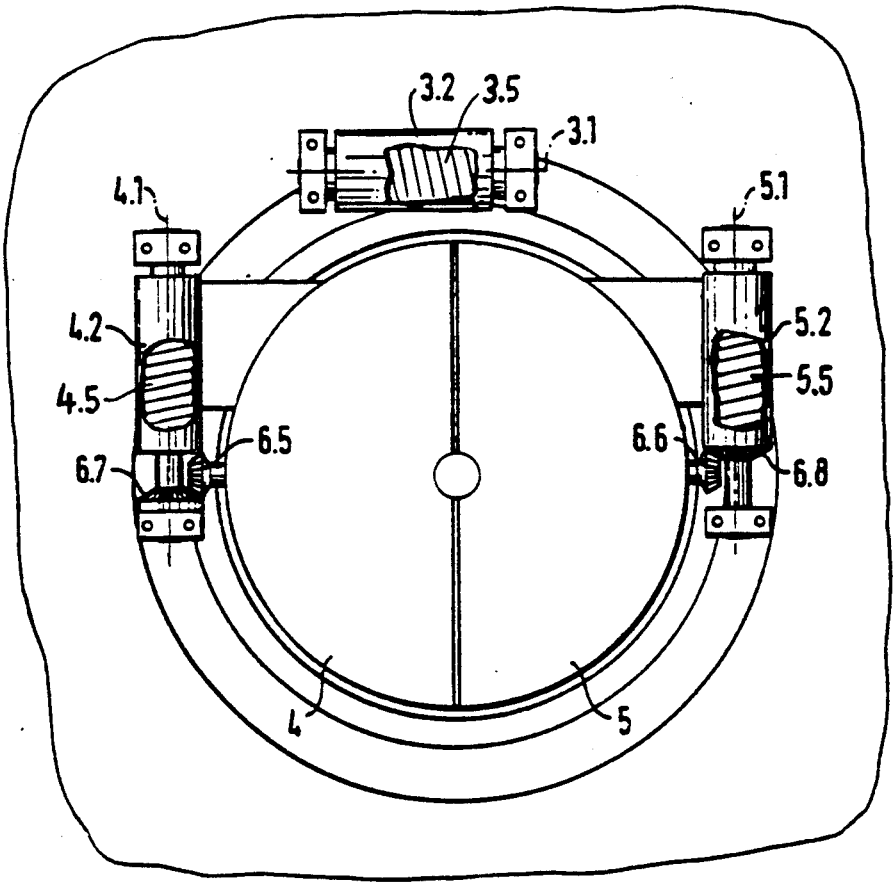
FIG. 2 is a top view of the hatchway in FIG. 1.

FIGS. 1 and 2 illustrate part of the roof of a military tank in the vicinity of a hatchway that it can be entered and exited through. The tank's roof 1 is provided with armor and clad with an additional layer of thicker armor 2. The inside of the hatchway can be closed with a hatch 3 that is connected to armored roof 1 by way of a spring-reinforced articulation 3.2 and folds up and out around an axis 3.1. When the hatchway is closed, as illustrated in FIGS. 1 and 2, hatch 3 completely covers it. There is a seal 7 between the edge of the hatchway and the edge of the hatch.

Above hatch 3 are two roof-protection hatch components 4 and 5, which also fold up and out, specifically around axes 4.1 and 5.1, which axes are horizontal and perpendicular to the pivoting axis 3.1 of hatch 3. The hatchway in this embodiment is round, and hatch 3 is accordingly a circle, whereas roof-protection components 4 and 5 are semicircles and will fold down into a whole circle on the same level when closing off the hatch. Components 4 and 5 are locked both open and closed by locking mechanisms 4.3 and 5.3, which are represented only schematically. When the hatch is open, as represented by the dot-and-dash lines in FIG. 1, both roof-protection components 4 and 5 and hatch 3 extend up at an angle of at least 90°. Hatch 3 is locked closed by mechanisms 3.3 and open by mechanism 3.4. Both hatch 3 and roof-protection hatch components 4 and 5 rest on springs 3.5, 4.5, 5.5 and are relatively easy to lift.

Unillustrated detents can also be provided to maintain hatch 3 at an intermediate angle of 30° for example for ventilation.

Roof-protection components 4 and 5 are secured up at an angle of at least 90 no matter how far hatch 3 has been raised.

The hatchway is opened and closed with a manually operated wheel 6 on the inner surface of hatch 3. The shaft 6.1 of wheel 6 extends through the center of hatch 3 and, outside the hatch, engages a beveled wheel 6.2 that engages in turn two other beveled wheels 6.3, each mounted on a transmission shaft 6.4. These shafts are mounted radially on the outside of hatch 3 and move back and forth axially. At the end of each shaft 6.4 is a beveled wheel 6.5 and 6.6 that, when the hatchway is closed, engage beveled wheels 6.7 and 6.8 in the mechanisms 4.2 and 5.2 that open roof-protection components 4 and 5.

The hatch can be manipulated from inside the vehicle as will now be described with reference to FIGS. 1, 2, and 5.

Figure 5:
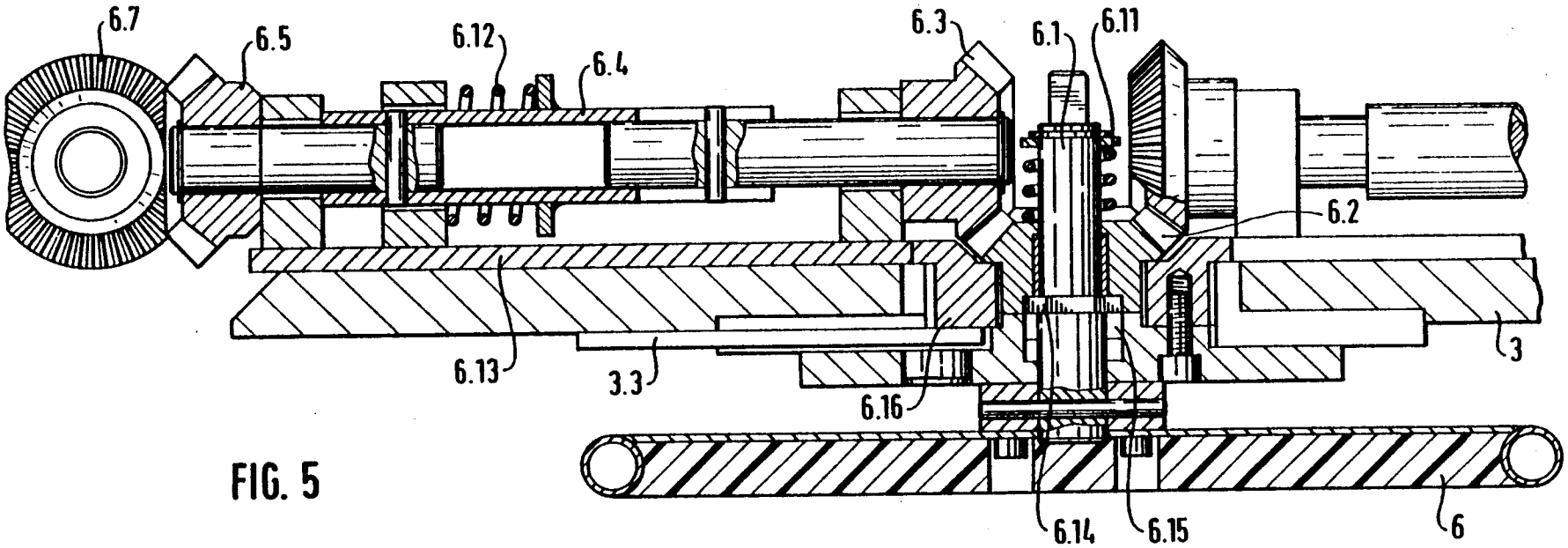
FIG. 5 is a slightly larger-scale detail of the section in FIG. 1, illustrating the mechanism that opens and closes the embodiments illustrated in FIGS. 1 through 4.

FIG. 5 illustrates part of the hatchway closed and locked with part of roof-protection components 4 and 5 left out.

Roof-protection hatch components 4 and 5 are opened simultaneously. Only one half will, for simplicity's sake, be discussed.

Roof-protection hatch component 4 is unlocked from inside with mechanism 4.3. Wheel 6 is rotated counterclockwise, opening the spring-supported component by way of the hexagon 6.14 on shaft 6.1 and by way of beveled wheels 6.2 and 6.3, transmission shaft 6.4, and beveled wheels 6.5 and 6.7, upon which the component snaps into the locking mechanism.

Hatch 3 is unlocked by pulling the wheel down against the force of a compression spring 6.11, upon which the hexagon 6.14 on shaft 6.1 slips out of beveled wheel 6.2 and engages a cam that has a lifter 6.16 screwed onto it.

As manually operated wheel 6 continues to rotate counterclockwise, hatch 3 is unlocked by way of bolt 3.3. A rod 6.13 is accordingly simultaneously displaced radially toward the center of the hatch against the force of a compression spring, shifting wheel 6.5 out of beveled wheel 6.7. Hatch 3, supported by a compensation spring, can now be folded up and locked open.

How the hatchway can be closed from inside will now be described.

The detent lever 3.4 that secures hatch 3 is released and the hatch folded down. Wheel 6 is pulled and rotated clockwise to lock hatch 3. The detent lever 4.3 on roof-protection hatch component 4 is released. Wheel 6 is forced toward hatch 3 and rotated toward the right to fold down roof-protection hatch component 4, which is then locked.

Since all the detent and locking mechanisms ar also accessible from outside, the hatchway can also be opened and closed from outside.

Figure 3:
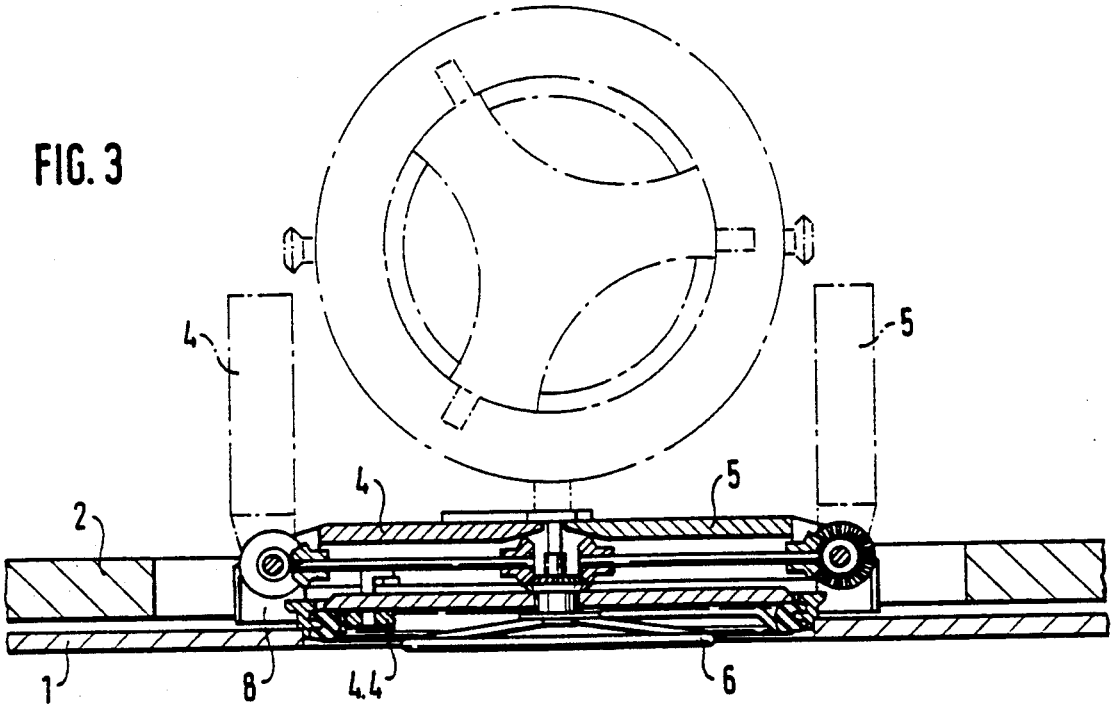
FIG. 3 is a section similar to that in FIG. 1 through a hatchway with a rotary ring.
Figure 4:
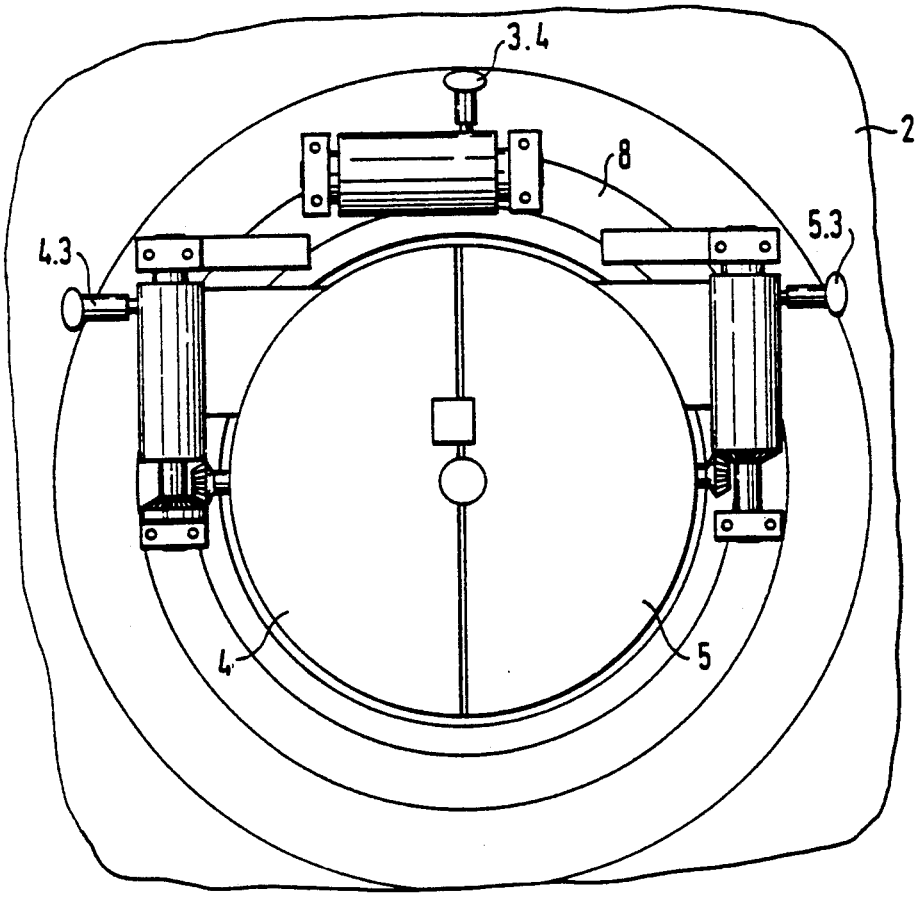
FIG. 4 is a top view of the hatchway illustrated in FIG. 3.

FIGS. 3 and 4 illustrate a version of the hatchway that differs from the embodiment illustrated in FIGS. 1 and in that hatch 3 and roof-protection components 4 and 5 are all mounted on a ring 8 accommodated in a recess in thicker armor 2 that revolves easily on ball-bearing mounted rollers. This design extensively compensates for the weight of roof-protection components 4 and 5, which are positioned diametrically opposite each other. The weight of hatch 3 can be compensated for with an unillustrated machine-gun carriage on rotary ring 8.

This approach renders the system relatively easy to rotate. Rotary ring 8 can be provided with an unillustrated brake to secure it in any position. The opening mechanisms in this embodiment are otherwise like that of the version described with reference to FIGS. 1 and 2, and the hatches are operated similarly.

Figure 8:
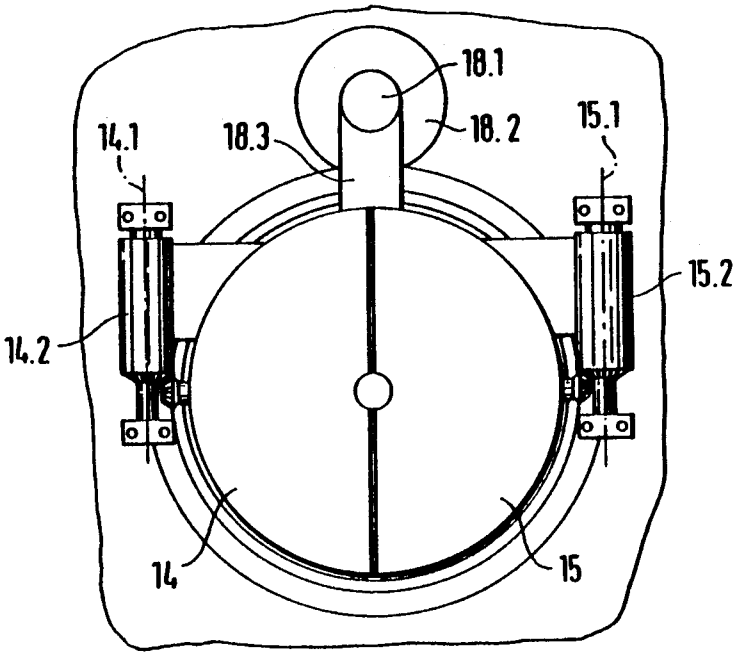
FIG. 8 is a top view of the hatchway illustrated in FIGS. 6 and 7.
Figure 6:
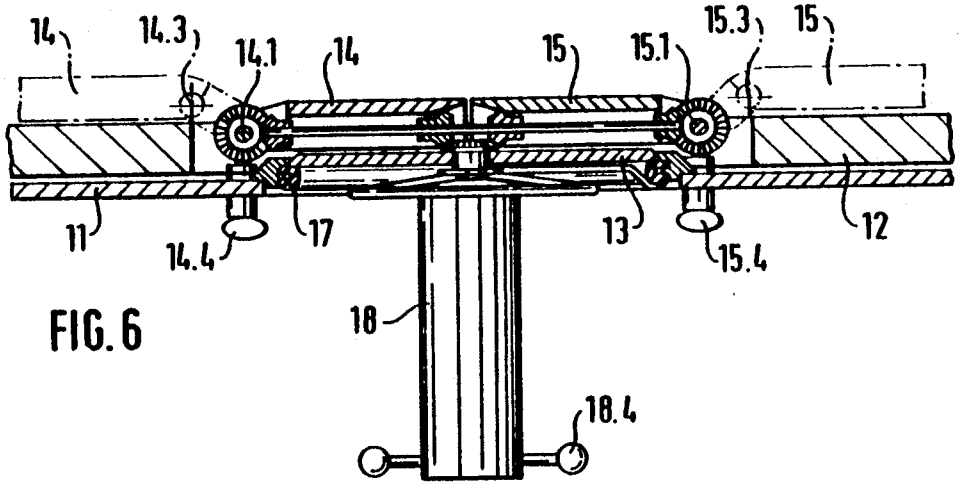
FIG. 6 is a section similar to that in FIG. 1 through another embodiment of a hatchway.
Figure 7:
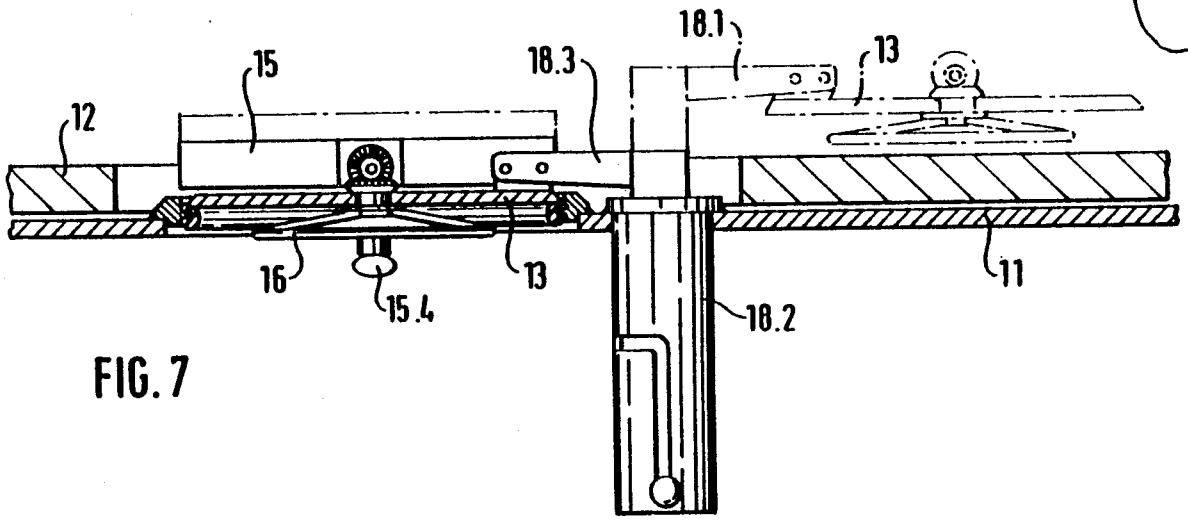
FIG. 7 is a section through the embodiment illustrated in FIG. 6 but at a right angle thereto.

The hatchway illustrated in FIGS. 6 through 8 differs slightly from the embodiments illustrated in FIGS. 1 through 5.

The roof 11 of the hull of the combat vehicle is clad with thicker armor 12 and accommodates a hatchway that can be closed with a hatch 13. There is again a seal 17 between the edge of hatch 13 and that of the hatchway. Positioned above hatch 13 are roof-protection components 14 and 15. These components, like the comparable structures in the foregoing embodiments, fold up and out around axes 14.1 and 15.1. An additional articulation 14.3 and 15.3 ensures that each component can fold out 180° into the open position paralleling the upper surface of thicker armor 12 as illustrated in FIG. 6. Roof-protection components 14 and 15 are opened and closed by way of a manually operated wheel 16 that is connected by beveled-wheel transmissions like those described with reference to FIGS. 1 and 2 to the mechanisms 14.2 and 15.2 that open and close roof-protection components 14 and 15.

The hatch 13 in this embodiment does not fold up but is lifted vertically and pivoted to one side around a vertical axis. This motion is governed by an elevation-and-rotation mechanism 18, from which the hatch 13 is suspended by way of an articulated arm 18.3. Arm 18.3 is attached to a post 18.1 that slides up and down and rotates in a cylinder that is fastened to roof 11 and has a handle 18.4 at the bottom.

Hatch 13 is opened, once roof-protection components 14 and 15 have been unlocked and folded out, as previously described herein by activating handle 16, whereupon elevation-and-rotation mechanism 18 raises the hatch and pivots it out 180° into the position represented by the dot-and-dash lines in FIG. 7. Hatch 13 must be lifted high enough to pivot out of the way above roof-protection components 14 and 15. Both the hatch and the two components can of course be locked into and released from their limiting positions. The hatchway in this embodiment can also be opened and closed from outside.

What is claimed is:

1. An armored combat vehicle comprising at least one entry-and-exit hatchway in a top portion that closes with a hatch completely covering it, and at least two additional movable roof-protection components above the hatch that completely cover the hatchway, extending in the same plane at least when closed, and each covering part of the hatchway and both covering it completely.

2. The combat vehicle as in claim 1 further comprising means mounting the hatch for movement between a closed position and an open position.

3. The combat vehicle as in claim 1, further comprising a rotary ring mounting the at least two roof-protection components and hatch on the vehicle.

4. The combat vehicle as in claim 1, further comprising a manually operated wheel with a rotating shaft that extends through the hatch and connected by cogwheels to mechanisms that open the at least two roof-protection components.

5. The combat vehicle as in claim 1, further comprising springs for counter balancing the weights of the at least two roof-protection components and the hatch while they are opened and closed.

6. The combat vehicle as in claim 1, further comprising means mounting the at least two roof-protection components for folding up movement up to a prescribed maximum angle of exposure around two parallel and horizontal axes.

7. The combat vehicle as in claim 6, further comprising means mounting the hatch for folding up movement around a horizontal axis that is perpendicular to the axes of the at least two roof-protection components.

8. The combat vehicle as in claim 6, further comprising means mounting the hatch for vertical displacement and pivotal movement around a vertical axis when vertically displaced.

* * * * *